US005991940A

United States Patent [19]

Fortier

[11] Patent Number: 5,991,940

[45] Date of Patent: Nov. 30, 1999

[54] BASE STRUCTURE FOR ABOVE-GROUND SWIMMING POOL

[76] Inventor: Denis Fortier, 141 des Bouleaux, Magog Québec, Canada, J1X 5W7

[21] Appl. No.: 09/039,006

[22] Filed: Mar. 13, 1998

[30] Foreign Application Priority Data

Sep. 18, 1997 [CA] Canada ..... 2212397

[51] Int. Cl.[6] ..... E04H 4/00

[52] U.S. Cl. ..... 4/506; 4/488

[58] Field of Search ..... 4/488, 506, 513, 4/592, 593; 248/346.5, 346.02, 615, 633, 634, 678; 52/169.5

[56] References Cited

U.S. PATENT DOCUMENTS

| | | | |
|---|---|---|---|
| 1,403,478 | 1/1922 | Bingay . | |
| 3,352,525 | 11/1967 | Lowes . | |
| 3,644,942 | 2/1972 | Haight | 4/506 |
| 3,748,665 | 7/1973 | Viessmann | 4/506 |
| 3,788,581 | 1/1974 | Rutzick | 248/346.02 |
| 4,055,922 | 11/1977 | Ellington et al. . | |
| 4,182,087 | 1/1980 | Schall et al. . | |
| 4,464,802 | 8/1984 | Glonek et al. | 4/506 |
| 4,782,538 | 11/1988 | Chisholm et al. . | |
| 5,054,135 | 10/1991 | Dallaire et al. | 4/488 |
| 5,231,807 | 8/1993 | Aymes . | |
| 5,768,842 | 6/1998 | Austin | 52/169.5 |
| 5,769,376 | 6/1998 | Bostic et al. | 248/346.02 |

*Primary Examiner*—Charles R. Eloshway
*Attorney, Agent, or Firm*—Quarles & Brady

[57] ABSTRACT

An above-ground swimming pool base structure for supporting the swimming pool. The base structure comprises a plurality of base units so that when linked together, they form a shape matching the contour of the above-ground swimming pool. Each base unit comprises an upper and lower surface. The lower surface is adapted to rest on the ground and the upper surface is adapted to receive a bottom portion of the above-ground swimming pool wall. The base units are made of a flexible and compressible material that can withstand pressure caused by temperature variations.

5 Claims, 3 Drawing Sheets

BASE STRUCTURE FOR ABOVE-GROUND SWIMMING POOL

FIELD OF THE INVENTION

The present invention broadly relates to above-ground swimming pools. More particularly, it relates to a structure for supporting the upright wall of an above-ground swimming pool. The present invention also relates to a method for installing such base structure.

BACKGROUND OF THE INVENTION

Unevenness of the ground caused by successive freezing and thawing of same is very damaging to above-ground swimming pool substructures. Indeed, unevenness of the ground often causes the walls of the swimming pool to undulate at its base, causing them to collapse, which consequently results in misalignment of the liner which in turn causes the latter to fall off and tear.

Such problem is often encountered with conventional installations viz when the wall of the above-ground swimming pool is anchored in either sand, dust rocks or cement.

It is known to use a base structure for supporting swimming pools and/or reservoirs but the ones currently used are quite different from the base structure of the present invention.

U.S. Pat. No. 5,231,807 describes a swimming pool support structure which is incorporated in the swimming pool structure.

U.S. Pat. No. 3,352,525 is concerned with a base structure. The base structure comprises a plurality of base portions so that when linked together, they also form the floor of the swimming pool.

U.S. Pat. No. 4,403,478 is also concerned with a base structure for transformer tanks. The base consists essentially in a grid-like structure which extends throughout the base of the swimming pool.

SUMMARY OF THE INVENTION

It is an object of the present invention to provide a base structure that will withstand temperature fluctuations and thus will prevent damages caused by unevenness of the ground during freezing and thawing of same.

It is a further object of the present invention to provide a method for installing an above-ground swimming pool by means of the above-mentioned base structure.

The base structure in accordance with the present invention is adapted to be installed under an above-ground swimming pool and therefore support same.

More precisely, the present invention is concerned with a base structure for supporting an above-ground swimming pool, the above-ground swimming pool having a given contour defined by an upright wall, the wall comprising an upper edge and a bottom edge, the base structure comprising:

- a plurality of a plurality of base units linked together and forming a shape matching the contour of the above-ground swimming pool, each base unit comprising:
  - a bottom surface devised to sit on the ground; and
  - an upper surface comprising an inward portion and an outward portion, the inward portion extending upwards from the upper surface and forming a shoulder for setting in place a corresponding segment of the bottom edge of the above-ground swimming pool wall such that segment extends along the longitudinal shoulder.

The outward portion preferably comprises at least one drain groove extending transversely thereon from said shoulder.

Such a base structure has the advantage of maintaining the above-ground swimming pool, namely its walls, intact from pressure arising through consecutive freezing and thawing of the ground.

Indeed, the base will prevent such damages by absorbing the pressure exerted on the swimming pool wall.

This base structure provides an additional advantage for swimming pools installed on metallic rails by preventing corrosion of the latter. In conventional installations, the metallic rail and the bottom portion of the swimming pool wall are sitting directly on the ground. The ground retaining moisture from the environment (e.g. rain) will cause corrosion of the metallic elements which are in permanent contact with it. Hence, the presence of a base structure which is installed under the swimming pool metallic groove will significantly reduce corrosion of both the metallic rails and the bottom edge of the swimming pool side walls because they are not in direct contact with the ground anymore. The base structure would serve as a moisture shield.

In the case of a swimming pool using resin made rails, the base structure will form a support to the rail preventing same to break.

The use of such base structure will also facilitate processing, such as landscaping around the swimming pool, as grass will not be able to grow around the area and sand used in the installation of the liner will not leak outside the swimming pool wall.

It is a further object of the invention to provide a method for erecting an above-ground swimming pool using such base structure.

The method for erecting an above-ground swimming pool having a given contour defined by an upright wall, the upright wall comprising a plurality of wall segments connected together, comprises the steps of:

- setting on the ground a base structure comprising a plurality of base units linked together to define a shape matching the contour of the above-ground swimming pool, each base unit being made of a high density foam and comprising:
  - a bottom surface devised to sit on the ground; and
  - an upper surface comprising an inward portion and an outward portion, the inward portion extending upwards from the upper surface and forming a longitudinal shoulder for setting in place a corresponding segment of a bottom edge of the above-ground swimming pool wall such that said segment extends along the longitudinal shoulder;
- fixing metallic rails along a junction defined between the shoulder and the outward portion of each base unit;
- mounting the bottom edge of a wall segment on said rails; and
- installing a liner over said swimming pool wall and inner surface defined by the wall.

DESCRIPTION OF A PREFERRED EMBODIMENT

Figure 1:
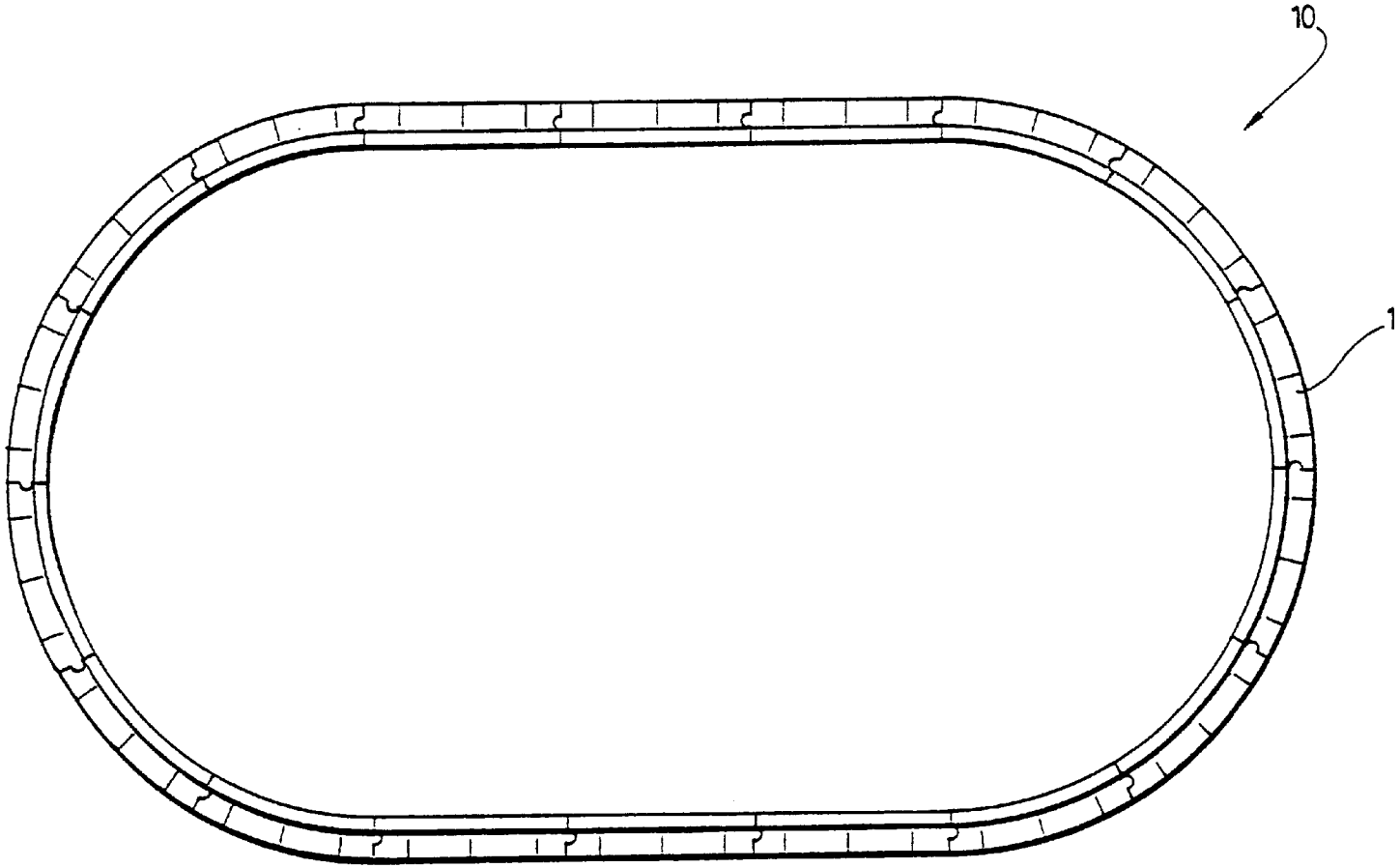
FIG. 1 is a top view of a base structure for an above-ground swimming pool comprising a plurality of linked base units according to a preferred embodiment of the present invention.

Referring to FIG. 1, a base structure (10) according to a preferred embodiment of the present invention is shown. As can be noted, the base structure comprises a plurality of base units (1) linked together. Each base unit (1) consists of a moulded structure of a predetermined shape so as to form a base structure having a shape matching the contour of the above-ground swimming pool. The base units (1) are made of a flexible and compressible high density foam which is preferably polystyrene. In another preferred embodiment, the base units may be made of a plastic blow moulded or a vacuum forming plastic. Each base unit comprises at each extremity a corresponding male (9) and female (8) element serving as attaching means for linking together the plurality of base units. The attaching means will facilitate the construction of the base structure and provide more stability of same, as each base unit is kept in place and in appropriate alignment with each other.

Figure 2:
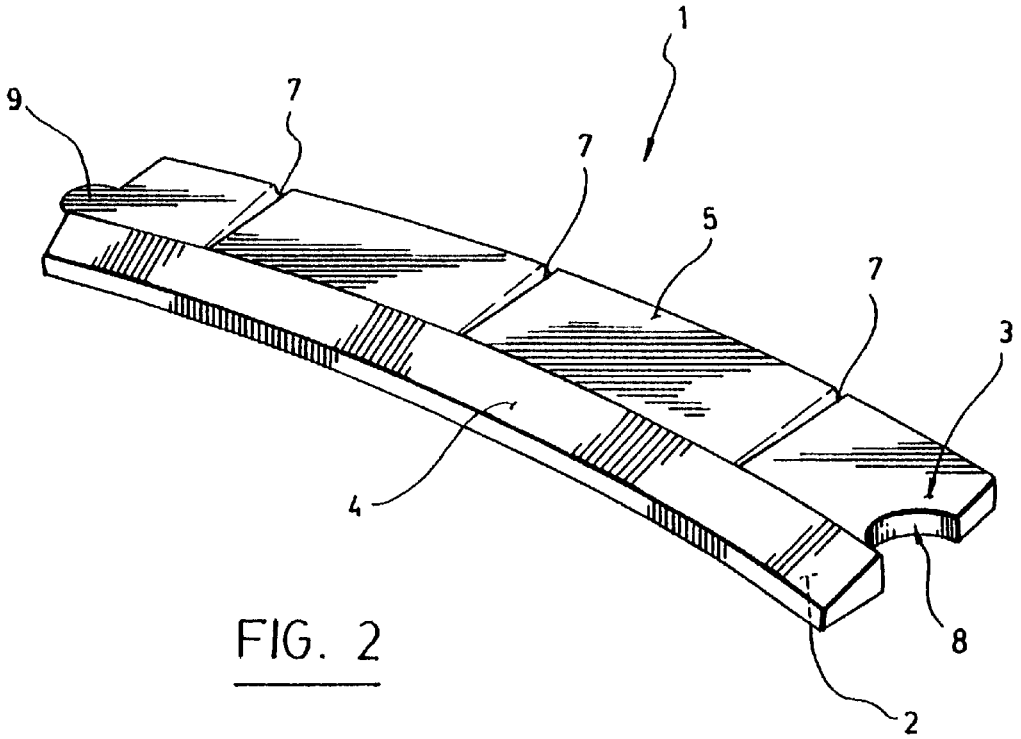
FIG. 2 is a perspective view of a moulded base structure unit as shown in FIG. 1.
Figure 3:
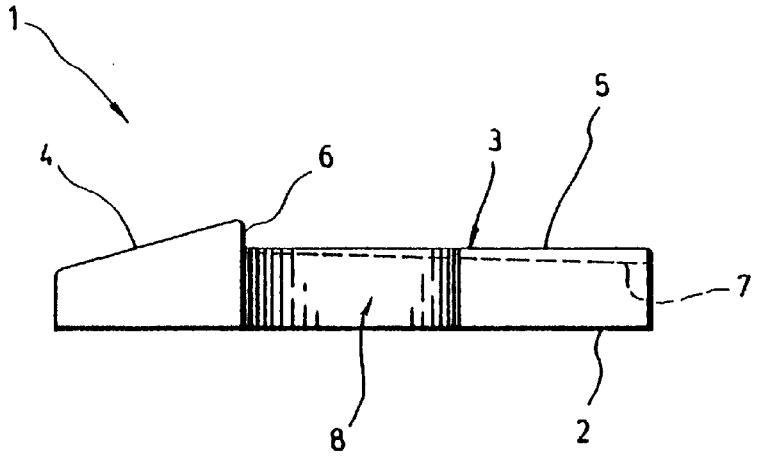
FIG. 3 is a side elevational view of the base structure unit shown in FIG. 2.

As shown in FIGS. 2 and 3, each base unit (1) comprises an upper and lower surface (2,3). The lower surface (2) is adapted to sit on the ground and provide stability to the above-ground swimming pool (10). For this reason, the lower surface (2) is generally flat.

Figure 4:
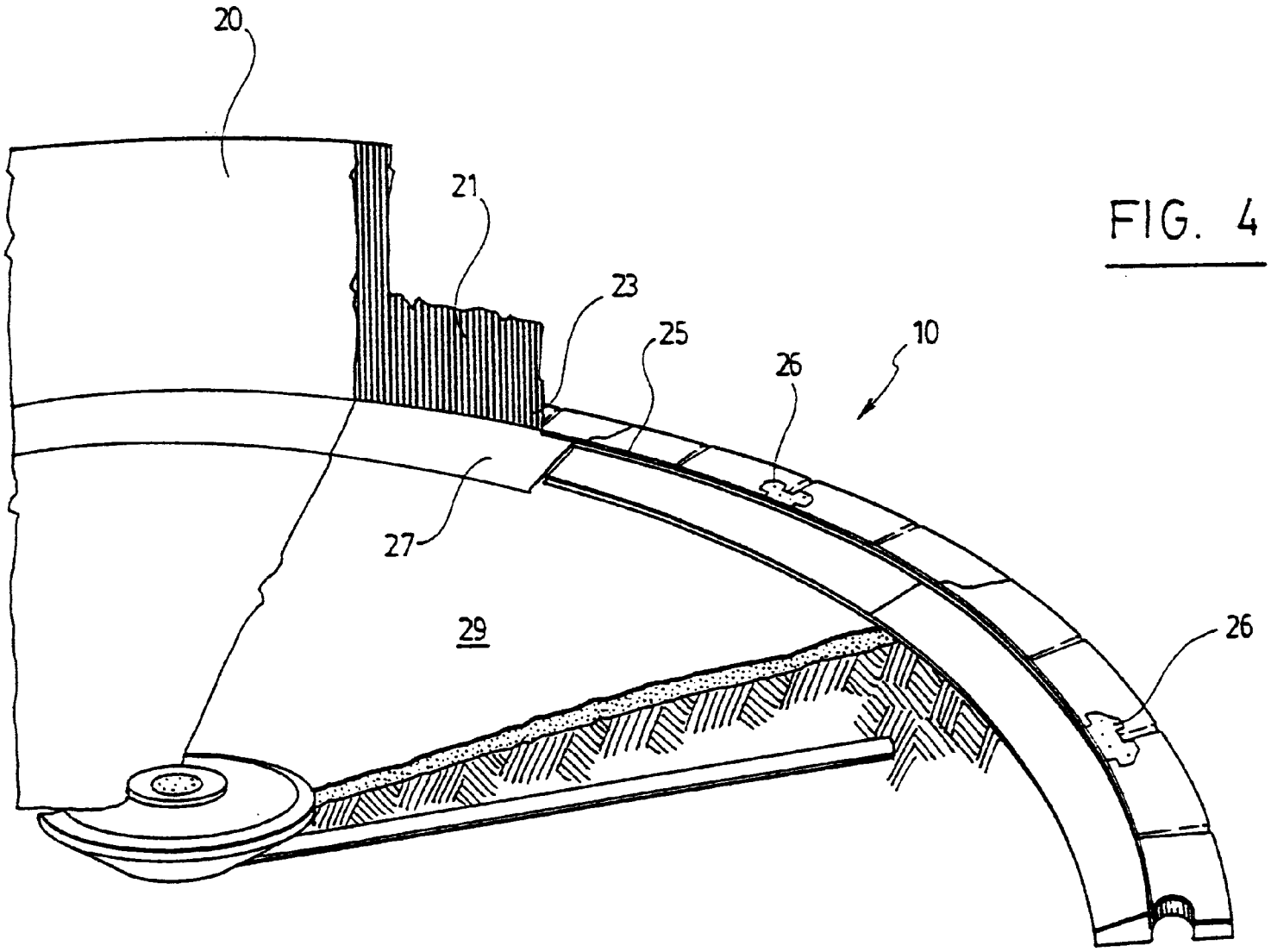
FIG. 4 is a perspective view of an above-ground swimming pool partially erected and using a plurality of linked base units as shown in FIGS. 2 and 3.

The upper surface (3) of the base unit (1) can be divided in two portions; an inward portion (4) and an outward portion (5). The inward portion (4) extends upwards from the upper surface (3) to form a longitudinal shoulder (6) for setting in place a corresponding segment of the bottom portion (23) of the above-ground swimming pool wall (21) of the above-ground swimming pool such that said segment extends along the longitudinal shoulder (6) as shown in FIG. 4. Preferably, the bottom portion (23) of the swimming pool wall (21) comprises a metallic rail (25). The metallic rail (25) comprising a corresponding segment which extends along the shoulder (6). The outward portion (5) preferably comprises at least one transversal groove (7) for draining water.

As can be further noted on FIGS. 2, 3 and 4, the base structure unit (1) preferably has a trapezoidal shape. In other words, the inward portion (4) would gradually extend downwards from the shoulder (6) so as to form a tapered end. As a result, this would facilitate the preparation of the bottom shape and the installation of the liner (20) of the above-ground swimming pool. In a preferred embodiment, the inward portion and the bottom shape are covered by a layer of sand prior to installing the liner (20).

Referring to FIG. 4, there is shown a perspective view of an above-ground swimming pool partially erected and using a plurality of base units linked together. As aforesaid, the present invention is also concerned with a method for erecting an above-ground swimming pool using such base structure. The method for erecting an above-ground swimming pool having a given contour defined by an upright wall, comprises essentially four steps, namely:

constructing the base structure by linking the base units together at the swimming pool installation site;

fixing the metallic rails on the base structure;

mounting the bottom edge of the swimming pool wall on the rails, thereby connecting together the wall segment; and installing a liner over said swimming pool wall and inner surface defined by the wall.

Once the base structure is in place, the metallic rails are fixed on the base structure. In a preferred embodiment, the metallic rails (25) used to fix the swimming pool wall are installed at a junction defined between the outward portion (5) of the upper surface (3) and the edge of the abutment shoulder (6). The bottom portion (23) of the swimming pool wall (21) is then mounted on the rails and a layer of sand (27) can be applied on the inward portion (4) of the base unit (1). The liner (20) is then installed on the swimming pool wall so as to cover the inner face of the wall (21) and on the ground so as to cover the area (29) defined within the swimming pool wall (21). Preferably a top rail for holding the liner (20) in place is installed.

Although the present invention has been explained hereinabove by way of a preferred embodiment thereof, it should be understood that the invention is not limited to this precise embodiment and that various changes and modifications may be effected therein without departing from the scope or spirit of the invention.

What is claimed is:

1. A base structure for supporting an above-ground swimming pool, the above-ground swimming pool having a given contour defined by an upright wall, the wall comprising an upper edge and a bottom edge, the base structure comprising:

a plurality of solid unitary base units linked together to define a shape matching the contour of the above-ground swimming pool, each base unit being made of a high density foam and comprising:

a bottom surface devised to sit on the ground;

an upper surface having a shape defining an inward portion and an outward portion, the inward portion extending upwards from the upper surface and forming a longitudinal shoulder for setting in place a corresponding segment of the bottom edge of the pool wall such that the segment extends along the longitudinal shoulder; and the outward portion comprising at least one drain groove extending transversely thereon from the shoulder to the outer edge of the outward portion and gradually sloping therealong.

2. A base structure according to claim 1, wherein said foam is made of polystyrene.

3. A base structure according to claim 2, wherein the inward portion gradually extends downwards from the shoulder so as to form a tapered end portion opposite the outward portion for receiving a liner.

4. A base structure according to claim 3, wherein each base unit comprises a first extremity provided with a male element and a second extremity provided with a female element, the male element of each base unit matching with the female element of an adjacent base unit to link the base units together.

5. A method for erecting an above-ground swimming pool having a given contour defined by an upright wall, the upright wall comprising a plurality of wall segments connected together, the method comprising the steps of:

setting on the ground a base structure comprising a plurality of solid unitary base units linked together to define a shape matching the contour of the above-ground swimming pool, each base unit being made of a high density foam and comprising:

a bottom surface devised to sit on the ground;

an upper surface having a shape defining an inward portion and an outward portion, the inward portion extending upwards from the upper surface and forming a longitudinal shoulder for setting in place the bottom edge of a corresponding segment of the above-ground swimming pool wall such that said segment extends along the longitudinal shoulder; and the outward portion comprising at least one drain groove extending transversely thereon from the shoulder to the outer edge of the outward portion and gradually sloping therealong;

fixing metallic rails along a junction defined between the shoulder and the outward portion of each base unit;

mounting the bottom edge of a wall segment on said metallic rails; and installing a liner over the inner surface of swimming pool wall.

* * * * *

UNITED STATES PATENT AND TRADEMARK OFFICE

CERTIFICATE OF CORRECTION

PATENT NO. : 5,991,940

DATED : November 30, 1999

INVENTOR(S) : Fortier

It is certified that error appears in the above-identified patent and that said Letters Patent is hereby corrected as shown below:

Column 1, line 34, replace "4,403,478" with --1,403,478--.

Signed and Sealed this

First Day of May, 2001

*Attest:*

Nicholas P. Godici

NICHOLAS P. GODICI

*Attesting Officer*

*Acting Director of the United States Patent and Trademark Office*